US006683036B2

(12) United States Patent
Foley et al.

(10) Patent No.: US 6,683,036 B2
(45) Date of Patent: Jan. 27, 2004

(54) CLEANING COMPOSITION

(75) Inventors: Peter Robert Foley, Cincinnati, OH (US); Howard David Hutton, III, Oregonia, OH (US); Carl-Eric Kaiser, Mason, OH (US); Yong Zhu, Cincinnati, OH (US); Lucio Pieroni, Hyogo (JP); Brian Xiaqing Song, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/909,403

(22) Filed: Jul. 19, 2001

(65) Prior Publication Data

US 2002/0039982 A1 Apr. 4, 2002

(30) Foreign Application Priority Data

Jul. 19, 2000 (WO) ..... PCT/US00/19619
Jul. 25, 2000 (WO) ..... PCT/US00/20255
Dec. 21, 2000 (WO) ..... PCT/US00/34907

(51) Int. Cl.[7] ..... C11D 1/62

(52) U.S. Cl. ..... 510/197; 510/235; 510/237; 510/245; 510/254; 510/264; 510/433; 510/499; 510/503; 510/506; 510/507; 510/101

(58) Field of Search ..... 510/197, 235, 510/237, 245, 254, 264, 433, 499, 503, 506, 507, 101

(56) References Cited

U.S. PATENT DOCUMENTS 5,102,573 A 4/1992 Han et al.
5,741,767 A * 4/1998 Nicholson et al. ..... 510/220
5,891,836 A * 4/1999 Kacher ..... 510/237
5,919,312 A * 7/1999 Wierenga et al. ..... 134/34
5,919,440 A * 7/1999 Kaiser et al. ..... 424/76.4
5,929,007 A 7/1999 Feng
6,001,789 A * 12/1999 Trinh et al. ..... 510/191
6,100,233 A * 8/2000 Sivik et al. ..... 512/26
6,225,277 B1 * 5/2001 Gordon ..... 510/475
6,277,808 B1 * 8/2001 Tcheou et al. ..... 510/417
6,323,171 B1 * 11/2001 Fonsny et al. ..... 510/384
6,342,473 B1 * 1/2002 Kott et al. ..... 510/357
2002/0037817 A1 3/2002 Foley et al.
2002/0037822 A1 3/2002 Foley et al.
2002/0169090 A1 11/2002 Foley et al.
2002/0183222 A1 12/2002 Foley et al.

FOREIGN PATENT DOCUMENTS

WO WO 94/28108 A1 12/1994
WO WO 98/07455 * 2/1998
WO WO 02/06436 A1 1/2002
WO WO 02/06437 A1 1/2002
WO WO 02/08373 A1 1/2002
WO WO 02/08374 A1 1/2002
WO WO 03/008528 A1 1/2003

* cited by examiner

*Primary Examiner*—Gregory Delcotto
(74) *Attorney, Agent, or Firm*—Richard S. Echler, Sr.; C. Brant Cook; Jeffrey V. Bamber

(57) ABSTRACT

A hard surface cleaning composition for removing cooked-, baked- or burnt-on soils from cookware and tableware, the composition comprising an organoamine solvent and wherein the composition has a liquid surface tension of less than about 24.5 mN/m and a pH, as measured in a 10% solution in distilled water, or least than 10.5. The composition can be used as pre-treatment prior to the dishwashing process. The composition provides excellent removal of polymerized grease from metal and glass substrates.

40 Claims, No Drawings

CLEANING COMPOSITION

TECHNICAL FIELD

The present invention is in the field of hard surface cleaning compositions, in particular it relates to products and methods suitable for the removal of cooked-, baked- and burnt-on soils from cookware and tableware.

BACKGROUND OF THE INVENTION

Cooked-, baked- and burnt-on soils are amongst the most severe types of soils to remove from surfaces. Traditionally, the removal of cooked-, baked- and burnt-on soils from cookware and tableware requires soaking the soiled object prior to a mechanical action. Apparently, the automatic dishwashing process alone does not provide a satisfactory removal of cooked-, baked- and burnt-on soils. Manual dishwashing process requires a tremendous rubbing effort to remove cooked-, baked- and burnt-on soils and this can be detrimental to the safety and condition of the cookware/tableware.

The use of cleaning compositions containing solvent for helping in the removal of cooked-, baked- and burnt-on solids is known in the art. For example, U.S. Pat. No. 5,102,573 provides a method for treating hard surfaces soiled with cooked-on, baked-on or dried-on food residues comprising applying a pre-spotting composition to the soiled article. The composition applied comprises surfactant, builder, amine and solvent. U.S. Pat. No. 5,929,007 provides an aqueous hard surface cleaning composition for removing hardened dried or baked-on grease soil deposits. The composition comprises nonionic surfactant, chelating agent, caustic, a glycol ether solvent system, organic amine and anti-redeposition agents.

WO-A-94/28108 discloses an aqueous cleaner concentrate composition, that can be diluted to form a more viscous use solution comprising an effective thickening amount of a rod micelle thickener composition, lower alkyl glycol ether solvent and hardness sequestering agent. The application also describes a method of cleaning a food preparation unit having at least one substantially vertical surface having a baked food soil coating. In practice, however, none of the art has been found to be very effective in removing baked-on, polymerized soil from metal and other substrates.

Thus, there is still need for cleaning compositions and methods used prior to the washing process of tableware and cookware soiled with cooked-on, baked-on or burnt-on food in order to facilitate the removal of these difficult food residues. There is also a need for cleaning compositions and methods having improved efficacy in baked-on soil removal.

SUMMARY OF THE INVENTION

According to a first aspect of the present invention, there is provided a hard surface cleaning composition for removing cooked-, baked- or burnt-on soils (such as grease, meat, dairy, fruit, pasta and any other food especially difficult to remove after the cooking process) from cookware and tableware (including stainless steel, glass, plastic, wood and ceramic objects), wherein the composition comprises an organoamine solvent. In general terms, the composition has a liquid surface tension of less than about 26 mN/m, preferably less than about 25 mN/m, preferably less than about 24.5 mN/m and more preferably less than about 24 mN/m and a pH, as measured in a 10% solution in distilled water, of at least 10.5. The organoamine solvent is present in the compositions herein in an effective amount, i.e., in an amount effective to provide cooked-, baked- or burnt-on soil removal functionality. The efficacy of the organoamine solvent at low liquid surface tensions and high pH appears to be related to its ability to act as an agent for swelling, hydrating or otherwise solvating the cooked-, baked- or burnt-on soil. A soil swelling agent is understood herein to be a substance or composition capable of swelling cooked-, baked- or burnt-on soil deposited on a substrate after treating said substrate with the soil swelling agent without the application of external mechanical forces. Soil swelling effect can be quantified by the soil swelling index.

The composition of the invention preferably has a pH, as measured in a 10% solution in distilled water, from at least about 10.5, preferably from about 11 to about 14 and more preferably from about 11.5 to about 13.5. In the case of cleaning of cooked-, baked- or burnt-on soils cleaning performance is related in part to the high pH of the cleaning composition. However, due to the acidic nature of some of the soils, such as for example cooking oil, a reserve of alkalinity is desirable in order to maintain a high pH. On the other hand the reserve alkalinity should not be so high as to risk damaging the skin of the user. Therefore, the compositions of the invention preferably have a reserve alkalinity of less than about 5, more preferably less than about 4 and especially less than about 3. "Reserve alkalinity", as used herein refers to, the ability of a composition to maintain an alkali pH in the presence of acid. This is relative to the ability of a composition to have sufficient alkali in reserve to deal with any added acid while maintaining pH. More specifically, it is defined as the grams of NaOH per 100 cc's, exceeding pH 9.5, in product. The reserve alkalinity for a solution is determined in the following manner.

A Mettler DL77 automatic titrator with a Mettler DG115-SC glass pH electrode is calibrated using pH 4, 7 and 10 buffers (or buffers spanning the expected pH range). A 1% solution of the composition to be tested is prepared in distilled water. The weight of the sample is noted. The pH of the 1% solution is measured and the solution is titrated down to pH 9.5 using a solution of 0.25N HCL. The reserve alkalinity (RA) is calculated in the following way:

$$RA = \%\ \mathrm{NaOH} \times \text{Specific gravity}$$

$$\%\ \mathrm{NaOH} = ml\ \mathrm{HCl} \times \text{Normality of HCl} \times 40 \times 100 / \text{Weight of sample aliquot titrated}(g) \times 1000$$

The addition of low level of surfactant selected from anionic, amphoteric, zwitterionic, nonionic and semi-polar surfactants and mixtures thereof, to the composition of the invention aids the cleaning process and also helps to care for the skin of the user. Preferably the level of surfactant is from about 0.05 to about 10%, more preferably from about 0.09 to about 5% and more preferably from 0.1 to 2%. A preferred surfactant for use herein is an amine oxide surfactant.

The soil swelling index (SSI) is a measure of the increased thickness of soil after treatment with a substance or composition in comparison to the soil before treatment with the substance or composition. It is believed, while not being limited by theory, that the thickening is caused, at least in part, by hydration or solvation of the soil. Swelling of the soil makes the soil easier to remove with no or minimal application of force, e.g. wiping, rinsing or manual and automatic dishwashing. The measuring of this change of soil thickness gives the SSI.

The amount of substance or composition necessary to provide soil swelling functionality will depend upon the nature of the substance or composition and can be determined by routine experimentation. Other conditions effective for soil swelling such as pH, temperature and treatment time can also be determined by routine experimentation. Preferred herein, however are organoamine solvents effective in swelling cooked-, baked- or baked-on soils such as polymerised grease or carbohydrate soils on glass or metal substrates, whereby after the organoamine has been in contact with the soil for 45 minutes or less, preferably 30 min or less and more preferably 20 min or less at 20° C., the organoamine has an SSI at 5% aqueous solution and pH of 12.8 of at least about 15%, preferably at least about 20%, more preferably at least about 30% and especially at least about 50%. Preferably also the choice of organoamine is such that the final compositions have an SSI measured as neat liquids under the same treatment time and temperature conditions of at least about 100%, preferably at least about 200% and more preferably at least about 500%. Highly preferred soil swelling agents and final compositions herein meet the SSI requirements on polymerized grease soils according to the procedure set out below.

SSI is determined herein by optical profilometry, using, for example, a Zygo NewView 5030 Scanning White Light Interferometer. A sample of polymerized grease on a brushed, stainless steel coupon is prepared as described hereinbelow with regard to the measurement of polymerized grease removal index. Optical profilometry is then run on a small droplet of approximately 10 $\mu$m thickness of the grease at the edge of the grease sample. The thickness of the soil droplet before ($S_i$) and after ($S_f$) treatment is measured by image acquisition by means of scanning white light interferometry. The interferometer (Zygo NewView 5030 with 20X Mirau objective) splits incoming light into a beam that goes to an internal reference surface and a beam that goes to the sample. After reflection, the beams recombine inside the interferometer, undergo constructive and destructive interference, and produce a light and dark fringe pattern. The data are recorded using a CCD (charged coupled device) camera and processed by the software of the interferometer using Frequency Domain Analysis. The dimensions of the image obtained (in pixels) is then converted in real dimension ($\mu$m or mm). After the thickness of the soil ($S_i$) on the coupon has been measured the coupon is soaked in the invention composition at ambient temperature for a given length of time and the thickness of the soil ($S_f$) is measured repeating the procedure set out above. If necessary, the procedure is replicated over a sufficient member of droplets and samples to provide statistical significance.

The SSI is calculated in the following manner:

$$SSI=[(S_f-S_i)/S_i]\times 100$$

The compositions herein are characterized by extremely low liquid surface tensions and contact angles on polymerized grease-coated substrates. In preferred embodiments of the invention the composition is selected such as to display an advancing contact angle on a polymerised grease-coated glass substrate at 25° C. of less than about 20°, preferably less than about 10° and more preferably less than about 5°.

The method for determining contact angle is as follows. A sample plate (prepared as described below) is dipped into and pulled out of a liquid and contact angles calculated after Wilhelmy Method. The force exerted on the sample according to the immersion depth is measured (using a Kruss K12 tensiometer and System K121 software) and is proportional to the contact angle of the liquid on the solid surface. The sample plate is prepared as follows: Spray 30–50 grams of Canola Oil into a beaker. Dip a glass slide (3×9×0.1 cm) into the Oil and thoroughly coat the surface. This results in an evenly dispersed layer of oil on the surface. Adjust the weight of product on the slide's surface until approximately 0.5 g of oil has been delivered and evenly distributed. At this point, bake the slides at 250° C. for 20 minutes, and allow to cool to room temperature.

According to another aspect of the invention, there is provided a hard surface cleaning composition for removing cooked-, baked- or burnt-on soils from cookware and tableware, the composition comprising an organoamine solvent and wherein the composition displays an advancing contact angle on a polymerised grease-coated glass substrate at 25° C. of less than about 20°, preferably less than about 10° and more preferably less than about 5°.

The compositions of the invention may additionally comprise a spreading auxiliary. The function of the spreading auxiliary is to reduce the interfacial tension between the organoamine and soil, thereby increasing the wettability of soils by the organoamine. The spreading auxiliary when added to the compositions herein leads to a lowering in the surface tension of the compositions, preferred spreading auxiliaries being those which lower the surface tension below that of the auxiliary itself. Especially useful are spreading auxiliaries able to render a surface tension below about 26 mN/m, preferably below about 24.5 mN/m and more preferably below about 24 mN/m, and especially below about 23.5 mN/m. Surface tensions are measured herein at 25° C.

Without wishing to be bound by the theory, it is believed that the organoamine penetrates and hydrates the soils. The spreading auxiliary facilitates the interfacial process between the organoamine and the soil and aids swelling of the soil. The soil penetration and swelling is believed to weaken the binding forces between soil and substrate. The resulting compositions are particularly effective in removing soils of a polymerized baked-on nature from metallic substrates.

Spreading auxiliaries for use herein can be selected generally from organic solvents, wetting agents and mixtures thereof. In preferred embodiments the liquid surface tension of the spreading auxiliary is less than about 30 mN/m, preferably less than about 28 mN/m, more preferably less than about 26 mN/m and more preferably less than about 24.5 mN/m. Suitable organic solvents capable of acting as spreading auxiliaries include alcoholic solvents, glycols and glycol derivatives and mixtures thereof. Preferred for use herein are mixtures of diethylene glycol monobutyl ether and propylene glycol butyl ether.

Wetting agents suitable for use as spreading auxiliaries herein are surfactants and include anionic, amphoteric, zwitterionic, nonionic and semi-polar surfactants. Preferred nonionic surfactants include silicone surfactants, such as Silwet copolymers, preferred Silwet copolymers include Silwet L-8610, Silwet L-8600, Silwet L-77, Silwet L-7657, Silwet L-7650, Silwet L-7607, Silwet L-7604, Silwet L-7600, Silwet L-7280 and mixtures thereof. Preferred for use herein is Silwet L-77.

Other suitable wetting agents include organo amine surfactants, for example amine oxide surfactants. Preferably, the amine oxide contains an average of from 12 to 18 carbon atoms in the alkyl moiety, highly preferred herein being dodecyl dimethyl amine oxide, tetradecyl dimethyl amine oxide, hexadecyl dimethyl amine oxide and mixtures thereof.

Highly preferred herein are hard surface cleaning compositions comprising mixed solvent systems based on organoamine solvents in combination with cosolvents acting as spreading auxiliaries. Also highly preferred from the viewpoint of optimum removal of baked-on polymerised soils are compositions comprising a solvent having a limited miscibility in water (herein referred to as a coupling solvent) preferably in combination with a fully-miscible solvent, both preferably at specific levels in composition. Thus in another aspect of the invention, there is provided a hard surface cleaning composition for removing cooked-, baked- or burnt-on soils from cookware and tableware, the composition comprising from about 10% to about 40%, preferably from about 12% to about 20% of organo solvent including from about 1% to about 15% of organoamine solvent and from about 7% to about 30% of solvent acting as spreading auxiliary and which includes at least about 3.5% of a water-miscible solvent and at least about 3.5% of a coupling solvent having limited miscibility in water.

A water-miscible solvent herein is a solvent which is miscible with water in all proportions at 25° C. A coupling solvent with limited miscibility is a solvent with is miscible with water in some but not all proportions at 25° C. Preferably the solvent has a solubility in water at 25° C. of less than about 30 wt %, more preferably less than about 20 wt %. Preferably also the solubility of water in the solvent at 25° C. is less than about 30 wt %, more preferably less than about 20 wt %.

A preferred spreading auxiliary herein comprises a mixture of a fully water-miscible organic solvent and a coupling organic solvent having limited miscibility in water and wherein the ratio of water-miscible organic solvent to coupling organic solvent is in the range from about 4:1 to about 1:20, preferably from about 2:1 to about 1:6, more preferably from about 1.5:1 to about 1:3. Other suitable spreading auxiliaries comprise a wetting agent having a liquid surface tension of less than about 30 mN/m, preferably less than about 28 mN/m, more preferably less than about 26 mN/m and more preferably less than 24.5 mN/m. Preferably the wetting agent is an amine oxide. Highly preferred spreading auxiliaries comprise a mixture of the coupling solvent and the wetting agent.

Thus, according to a further aspect of the invention, there is provided a hard surface cleaning composition for removing cooked-, baked- or burnt-on soils from cookware and tableware, the composition comprising an organoamine solvent, a coupling solvent having limited miscibility in water and a wetting agent and wherein the composition has a liquid surface tension of less than about 26 mN/m and preferably less than about 24.5 mN/m.

The compositions herein are further characterised by displaying surface tension lowering characteristics, which is believed is important for ensuring optimum soil removal performance on polymerised soils. Thus, according to another aspect of the invention, there is provided a hard surface cleaning composition for removing cooked-, baked- or burnt-on soils from cookware and tableware, the composition comprising an organic solvent system and a wetting agent, wherein the organic solvent system includes at least an organoamine solvent component and wherein the wetting agent is effective in lowering the surface tension of the solvent system to at least 1 mN/m less than that of the wetting agent.

Preferably the compositions of the present invention have a surface tension of less than about 24 mN/m and more preferably less than 23.5 m/N/m.

Suitable organoamine solvents for use herein include alkanolamines, alkylamines, alkyleneamines and mixtures thereof.

The compositions of the invention are characterized by excellent performance on polymerized grease and preferably the compositions of the present invention have a polymerised grease removal index of at least 25%, preferably at least 50%, more preferably at least 75%. Polymerized grease removal index is a measure of how much soil is removed from a surface after treatment with the composition of the invention. The soiled substrates are soaked in the invention composition at ambient temperature for about 45 min or less, preferably for about 30 min or less and more preferably for about 20 min or less and then washed in a dishwasher without detergent or rinsing agent. The substrates are then dried and weighed and the soil removal is determined by gravimetric analysis. The soiled substrates are prepared as follows: Stainless steel coupons/slides are thoroughly cleaned with the product of the invention and rinsed well with water. The slides are placed in a 50° C. room to facilitate drying, if needed. The coupons/slides are allowed to cool to room temperature (about half an hour). The coupons/slides are weighed. Canola Oil, is sprayed into a small beaker or tri-pour (100 mL beaker, 20–30 mL of Canola Oil). A one inch paint brush is dipped into the Canola Oil. The soaked brush is then rotated and pressed lightly against the side of the container 4–6 times for each side of the brush to remove excess Canola Oil. A thin layer of Canola Oil is painted onto the surface of the coupon/slide. Each slide is then stroked gently with a dry brush in order to ensure that only a thin coating of Canola Oil is applied (two even strokes should sufficiently remove excess). In this manner 0.1–0.2 g of soil will be applied to the coupon/slide. The coupons/slides are arranged on a perfectly level cookie sheet or oven rack and placed in a preheated oven at 245° C. The slides/coupons are baked for 20 minutes. Coupons/slides are allowed to cool to room temperature (45 minutes). The cool coupons/slides are then weighed.

It is a feature of the solvent-based compositions of the invention that they display excellent performance in direct application to soiled cookware and tableware. The organic solvent system includes at least one solvent component acting as soil swelling agent and desirably has a liquid surface tension of less than about 27 mN/m, preferably less than about 26 mN/m, more preferably less than about 25 mN/m. Furthermore, the organic solvent system preferably comprises a plurality of solvent components in levels such that the solvent system has an advancing contact angle on polymerised grease-coated glass substrate of less than that of corresponding compositions containing the individual components of the solvent system. Such solvent systems and compositions are formed to be optimum for the removal of baked-on soils having a high carbon content from cookware and tableware. The compositions are preferably in the form of a liquid or gel having a pH of greater than about 9, preferably greater than 10.5 and preferably greater than about 11 as measured at 25° C.

Apart from the solvent parameters described above, the compositions of the invention should also meet certain rheological and other performance parameter including both the ability to be sprayed and the ability to cling to surfaces. For example, it is desirable that the product sprayed on a vertical stainless steel surface has a flow velocity less than about 1 cm/s, preferably less than about 0.1 cm/s. For this purpose, the product is in the form of a shear thinning fluid having a shear index n (Herschel-Bulkey model) of from about 0 to about 0.8, preferably from about 0.3 to about 0.7, more preferably from about 0.4 to about 0.6. Highly preferred are shear thinning liquids having a shear index of 0.5 or lower. The fluid consistency index, on the other hand, can vary from about 0.1 to about 50 $Pa.s^n$, but is preferably less than about 1 $Pa.s^n$. More preferably, the fluid consistency index is from about 0.20 to about 0.15 Pa.s$^n$. The product preferably has a viscosity from about 0.1 to about 200 Pa s, preferably from about 0.3 to about 20 Pa s as measured with a Brookfield cylinder viscometer (model LVDII) using 10 ml sample, a spindle S-31 and a speed of 3 rpm. Specially useful for use herein are compositions having a viscosity greater than about 1 Pa s, preferably from about 2 Pa s to about 4 Pa s at 6 rpm, lower than about 2 Pa s, preferably from about 0.8 Pa s to about 1.2 Pa s at 30 rpm and lower than about 1 Pa s, preferably from about 0.3 Pa s to about 0.5 Pa s at 60 rpm. Rheology is measured under ambient temperature conditions (25° C.).

Suitable thickening agents for use herein include viscoelastic, thixotropic thickening agents at levels of from about 0.1% to about 10%, preferably from about 0.25% to about 5%, most preferably from about 0.5% to about 3% by weight. Suitable thickening agents include polymers with a molecular weight from about 500,000 to about 10,000,000, more preferably from about 750,000 to about 4,000,000. The preferred cross-linked polycarboxylate polymer is preferably a carboxyvinyl polymer. Such compounds are disclosed in U.S. Pat. No. 2,798,053, issued on Jul. 2, 1957, to Brown. Methods for making carboxyvinyl polymers are also disclosed in Brown. Carboxyvinyl polymers are substantially insoluble in liquid, volatile organic hydrocarbons and are dimensionally stable on exposure to air.

Other suitable thickening agents include inorganic clays (e.g. laponites, aluminium silicate, bentonite, fumed silica). The preferred clay thickening agent can be either naturally occurring or synthetic. Preferred synthetic clays include the synthetic smectite-type clay sold under the trademark Laponite by Southern Clay Products, Inc. Particularly useful are gel forming grades such as Laponite RD and sol forming grades such as Laponite RDS. Natural occurring clays include some smectite and attapulgite clays. Mixtures of clays and polymeric thickeners are also suitable for use herein. Preferred for use herein are synthetic smectite-type clays such as Laponite and other synthetic clays having an average platelet size maximum dimension of less than about 100 nm. Laponite has a layer structure which in dispersion in water, is in the form of disc-shaped crystals of about 1 nm thick and about 25 nm diameter. Small platelet size is valuable herein for providing a good sprayability, stability, rheology and cling properties as well as desirable aesthetic.

Other types of thickeners which can be used in this composition include natural gums, such as xanthan gum, locust bean gum, guar gum, and the like. The cellulosic type thickeners: hydroxyethyl and hydroxymethyl cellulose (ETHOCEL and METHOCEL® available from Dow Chemical) can also be used. Natural gums seem to influence the size of the droplets when the composition is being sprayed. It has been found that droplets having an average equivalent geometric diameter from about 3 $\mu$m to about 10 $\mu$m, preferably from about 4 $\mu$m to about 7 $\mu$m, as measured using a TSI Aerosizer, help in odor reduction. Preferred natural gum for use herein is xanthan gum.

Highly preferred herein from the viewpoint of sprayability, cling, stability, and soil penetration performance is a mixture of Laponite and xanthan gum. Additionally, Laponite/xanthan gum mixtures help the aesthetics of the product and at the same time reduce the solvent odor.

In preferred embodiments the hard surface cleaning compositions comprise an organic solvent system including at least one solvent component acting as soil-swelling agent and wherein the organic solvent system is selected from alcohols, amines, esters, glycol ethers, glycols, terpenes and mixtures thereof, including at least one organoamine solvent component. Suitable organic solvents can be selected from organoamine solvents, inclusive of alkanolamines, alkylamines, alkyleneamines and mixtures thereof; alcoholic solvents inclusive of aromatic, aliphatic (preferably $C_4$–$C_{10}$) and cycloaliphatic alcohols and mixtures thereof; glycols and glycol derivatives inclusive of $C_2$–$C_3$ (poly) alkylene glycols, glycol ethers, glycol esters and mixtures thereof; and mixtures selected from organoamine solvents, alcoholic solvents, glycols and glycol derivatives. Highly preferred organoamine solvents include 2-aminoalkanol solvents as disclosed in U.S. Pat. No. 5,540,846.

In preferred compositions of the present invention the organic solvent comprises organoamine (especially alkanolamine) solvent and glycol ether solvent, preferably in a weight ratio of from about 3:1 to about 1:3, and wherein the glycol ether solvent is selected from ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol monobutyl ether, dipropylene glycol monobutyl ether, ethylene glycol phenyl ether and mixtures thereof. Preferred organoamine for use herein are alkanolamines, especially monoethanol amine, methyl amine ethanol and 2-amino-2methyl-propoanol. In a preferred composition the glycol ether is a mixture of diethylene glycol monobutyl ether and propylene glycol butyl ether, preferably in a weight ratio of from about 1:2 to about 2:1.

A preferred organic solvent system for use herein has a volatile organic content above 1 mm Hg of less than about 50%, preferably less than about 20%, more preferably less than about 10%. Preferably, the organic solvent is essentially free of solvent components having a boiling point below about 150° C., flash point below about 50° C., preferably below 100° C. or vapor pressure above about 1 mm Hg. A highly preferred organic solvent system has a volatile organic content above 0.1 mm Hg of less than about 50%, preferably less than about 20%, more preferably less than about 10% and even more preferably less than about 4%.

In terms of solvent parameters, the organic solvent can be selected from:

a) polar, hydrogen-bonding solvents having a Hansen solubility parameter of at least 20 $(Mpa)^{1/2}$, a polarity parameter of at least 7 $(Mpa)^{1/2}$, preferably at least 12 $(Mpa)^{1/2}$ and a hydrogen bonding parameter of at least 10 $(Mpa)^{1/2}$
b) polar non-hydrogen bonding solvents having a Hansen solubility parameter of at least 20 $(Mpa)^{1/2}$, a polarity parameter of at least 7 $(Mpa)^{1/2}$, preferably at least 12 $(Mpa)^{1/2}$ and a hydrogen bonding parameter of less than 10 $(Mpa)^{1/2}$
c) amphiphilic solvents having a Hansen solubility parameter below 20 $(Mpa)^{1/2}$, a polarity parameter of at least 7 $(Mpa)^{1/2}$ and a hydrogen bonding parameter of at least 10 $(Mpa)^{1/2}$
d) non-polar solvents having a polarity parameter below 7 $(Mpa)^{1/2}$ and a hydrogen bonding parameter below 10 $(Mpa)^{1/2}$ and
e) mixtures thereof.

A problem generally associated with the use of organic solvents in cleaning compositions is that of solvent odor—an odor which many consumers do not like and which they perceive as "malodorous". Such compositions can be made more attractive to consumers by using a high concentration of perfumes. The addition of such high concentrations of perfumes can alter or reduce the overall offensive character of the compositions, but it often results in an undesirably overbearing perfume odor. Even when the high perfume concentrations adequately modify, hide or otherwise mask the composition's malodors, these high concentrations do not necessarily result in improved perfume substantivity or longevity, thus resulting in the recurrence of malodor after the perfume has volatilized.

It has now been found that a select combination of perfume materials as defined herein can be incorporated into the compositions of the invention to effectively reduce the intensity of or mask any malodors associated with the use of solvents in the present compositions. Thus according to another aspect, the present invention provides a hard surface cleaning composition comprising organoamine solvent as herein before described and a solvent odor masking perfume or perfume base. In general terms, the odor-masking perfume or perfume base comprises a mixture of volatile and non-volatile perfume materials wherein the level of non-volatile perfume materials (boiling point above 250° C. at 1 atmosphere pressure) is preferably greater than about 20% by weight. In a preferred embodiment the perfume or perfume base comprises at least 0.001% by weight of an ionone or mixture of ionones inclusive of alpha, beta and gamma ionones. Preferred ionones are selected from gamma-Methyl Ionone, Alvanone extra, Irisia Base, Cassis Base 345-B and mixtures thereof. The perfume or perfume base may additionally comprise a musk. The musk preferably has a boiling point of more than about 250° C. Preferred musks are selected from Exaltolide Total, Habonolide and mixtures thereof. The masking perfume or perfume base can further comprise a high volatile perfume component or mixture of components having a boiling point of less than about 250° C. Preferred high volatile perfume components are selected from decyl aldehyde, benzaldehyde, cis-3-hexenyl acetate, allyl amyl glycolate, dihydromycenol and mixtures thereof.

The composition can additionally comprise a cyclodextrin, in order to help control solvent malodor. Cyclodextrins suitable for use herein are those capable of selectively absorbing solvent malodor causing molecules without detrimentally affecting the odor masking or perfume molecules. Compositions for use herein comprise from about 0.1 to about 3%, preferably from about 0.5 to about 2% of cyclodextrin by weight of the composition. As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in a donut-shaped ring. The specific coupling and conformation of the glucose units give the cyclodextrins a rigid, conical molecular structure with a hollow interior of a specific volume. The "lining" of the internal cavity is formed by hydrogen atoms and glycosidic bridging oxygen atoms, therefore this surface is fairly hydrophobic. The unique shape and physical-chemical property of the cavity enable the cyclodextrin molecules to absorb (form inclusion complexes with) organic molecules or parts of organic molecules which can fit into the cavity. Malodor molecules can fit into the cavity.

Preferred cyclodextrins are highly water-soluble such as, alpha-cyclodextrin and derivatives thereof, gamma-cyclodextrin and derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio)propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, and mixtures thereof.

Other cyclodextrin derivatives are disclosed in U.S. Pat. Nos. 3,426,011, 3,453,257, 3,453,258, 3,453,259, 3,453,260, 3,459,731, 3,553,191, 3,565,887, 4,535,152, 4,616,008, 4,678,598, 4,638,058, and 4,746,734.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available methylated beta-cyclodextrin is a randomly methylated beta-cyclodextrin having a degree of substitution of about 12.6. The preferred cyclodextrins are available, e.g., from American Maize-Products Company and Wacker Chemicals (USA), Inc.

The compositions of the present invention are especially useful in direct application for pre-treatment of cookware or tableware soiled with cooked-, baked- or burnt-on residues (or any other highly dehydrated soils). The compositions are applied to the soiled substrates in the form for example of a spray or foam prior to automatic dishwashing, manual dishwashing, rinsing or wiping. The pre-treated cookware or tableware can feel very slippery and as a consequence difficult to handle during and after the rinsing process. This can be overcome using divalent cations such as magnesium and calcium salts, especially suitable for use herein is magnesium chloride. The addition of from about 0.01% to about 5%, preferably from about 0.1% to about 3% and more preferably from about 0.4% to about 2% (by weight) of magnesium salts eliminates the slippery properties of the cookware or tableware surface without negatively impacting the stability of physical properties of the pre-treatment composition. The compositions of the invention can also be used as automatic dishwashing detergent compositions or as a component thereof.

In a method aspect, the invention provides a method of removing cooked-, baked- or burnt-on soils from cookware and tableware comprising treating the cookware/tableware with the hard surface cleaning composition of the invention. There is also provided a method of removing cooked-, baked- or burnt-on polymerised grease soils or carbohydrate soils from metallic cookware and tableware comprising treating the cookware/tableware with the hard surface cleaning of the present invention. These methods comprise the step of pre-treating the cookware/tableware with the composition of the invention prior to manual or automatic dishwashing. If desired, the process of removal of cooked-, burnt- and baked-on soils can be facilitated if the soiled substrate is covered with cling film after the cleaning composition of the invention has been applied in order to allow swelling of the soil to take place. Preferably, the cling film is left in place for a period of about 1 hour or more, preferably for about 6 hours or more.

DETAILED DESCRIPTION OF THE INVENTION

The present invention envisages hard surface cleaning compositions for the pre-treatment of cookware and tableware soiled with cooked-, baked- or burnt-on soils in order to facilitate the subsequent cleaning process. This is mainly achieved by compositions containing an organoamine solvent for swelling the soil. The invention also envisages methods for the removal of the soils mentioned above.

Soil swelling agent is a substance or composition effective in swelling cooked-, baked- and burnt-on soils as disclosed above. Preferred soil swelling agents for use herein include organoamine solvents.

Spreading auxiliary is a substance or composition having surface tension lowering properties as described above. Suitable spreading auxiliaries for use herein include surfactants (especially those having a surface tension of less than about 25 mN/m) such as silicone surfactants and amine oxide surfactants, organic solvents and mixtures thereof.

In general terms, organic solvents for use herein should be selected so as to be compatible with the tableware/cookware as well as with the different parts of an automatic dishwashing machine. Furthermore, the solvent system should be effective and safe to use having a volatile organic content above 1 mm Hg (and preferably above 0.1 mm Hg) of less than about 50%, preferably less than about 30%, more preferably less than about 10% and even more preferably less than about 4% by weight of the solvent system. Also they should have very mild pleasant odours. The individual organic solvents used herein generally have a boiling point above about 150° C., flash point above about 50° C., preferably below 100° C. and vapor pressure below about 1 mm Hg, preferably below 0.1 mm Hg at 25° C. and atmospheric pressure. In addition, the individual organic solvents preferably have a molar volume of less than about 500, preferably less than about 250, more preferably less than about 200 $cm^3$/mol, these molar volumes being preferred from the viewpoint of providing optimum soil penetration and swelling.

Solvents that can be used herein include: i) alcohols, such as benzyl alcohol, 1,4-cyclohexanedimethanol, 2-ethyl-1-hexanol, furfuryl alcohol, 1,2-hexanediol and other similar materials; ii) amines, such as alkanolamines (e.g. primary alkanolamines: monoethanolamine, monoisopropanolamine, diethylethanolamine, ethyl diethanolamine, beta-aminoalkanols; secondary alkanolamines: diethanolamine, diisopropanolamine, 2-(methylamino)ethanol; ternary alkanolamines: triethanolamine, triisopropanolamine); alkylamines (e.g. primary alkylamines: monomethylamine, monoethylamine, monopropylamine, monobutylamine, monopentylamine, cyclohexylamine), secondary alkylamines: (dimethylamine), alkylene amines (primary alkylene amines: ethylenediamine, propylenediamine) and other similar materials; iii) esters, such as ethyl lactate, methyl ester, ethyl acetoacetate, ethylene glycol monobutyl ether acetate, diethylene glycol monoethyl ether acetate, diethylene glycol monobutyl ether acetate and other similar materials; iv) glycol ethers, such as ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol butyl ether and other similar materials; v) glycols, such as propylene glycol, diethylene glycol, hexylene glycol (2-methyl-2,4 pentanediol), triethylene glycol, composition and dipropylene glycol and other similar materials; and mixtures thereof.

Preferred solvents to be used herein as soil swelling agents comprise alkanolamines, especially monoethanolamine, beta-aminoalkanols, especially 2-amine-2methyl-propanol (since it has the lowest molecular weight of any beta-aminoalkanol which has the amine group attached to a tertiary carbon, therefore minimize the reactivity of the amine group) and mixtures thereof Preferred solvents for use herein as spreading auxiliaries comprise glycols and glycol ethers, especially diethylene glycol monobutyl ether, propylene glycol butyl ether and mixtures thereof.

Apart from the soil swelling and spreading auxiliary agent the hard surface cleaning compositions herein can comprise additional components inclusive of surfactants other that the wetting agents hereinbefore described, builders, enzymes, bleaching agents, alkalinity sources, thickeners, stabilising components, perfumes, abrasives, etc. The compositions can also comprise organic solvents having a carrier or diluent function (as opposed to soil swelling or spreading) or some other specialised function. The compositions can be dispensed from any suitable device, such as bottles (pump assisted bottles, squeeze bottles), paste dispensers, capsules, pouches and multi-compartment pouches.

Surfactants

In compositions and methods of the present invention for use in automatic dishwashing the detergent surfactant is preferably low foaming by itself or in combination with other components (i.e. suds suppressers). In compositions and methods of the present invention for use in hard surface cleaning or pretreatment prior to dishwashing, the detergent surfactant is preferably foamable in direct application but low foaming in automatic dishwashing use. Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$–$C_{20}$, preferably $C_{10}$–$C_{18}$ linear or branched; cationic surfactants such as chlorine esters (U.S. Pat. Nos. 4,228,042, 4,239,660 and 4,260,529) and mono $C_6$–$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$–$C_{18}$ primary alcohols), ethoxylated-propoxylated alcohols (e.g., Olin Corporation's Poly-Tergent® SLF18), epoxy-capped poly(oxyalkylated) alcohols (e.g., Olin Corporation's Poly-Tergent® SLF18B—see WO-A-94/22800), ether-capped poly (oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$–$C_{20}$ alkyl amine oxides (preferred amine oxides for use herein include lauryldimethyl amine oxide and hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. Nos. 3,929,678, 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition. Preferred surfactant for use herein in automatic dishwashing are low foaming and include low cloud point nonionic surfactants and mixtures of higher foaming surfactants with low cloud point nonionic surfactants which act as suds suppresser therefor.

Builder

Builders suitable for use in cleaning compositions herein include water-soluble builders such as citrates, carbonates and polyphosphates e.g. sodium tripolyphosphate and sodium tripolyphosphate hexahydrate, potassium tripolyphosphate and mixed sodium and potassium tripolyphosphate salts; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of composition.

Preferably compositions for use herein comprise silicate in order to prevent damage to aluminium and some painted surfaces. Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Enzymes suitable herein include bacterial and fungal cellulases such as Carezyme and Celluzyme (Novo Nordisk A/S); peroxidases; lipases such as Amano-P (Amano Pharmaceutical Co.), M1 Lipase$^R$ and Lipomax$^R$ (Gist-Brocades) and Lipolase$^R$ and Lipolase Ultra$^R$ (Novo); cutinases; proteases such as Esperase$^R$, Alcalase$^R$, Durazym$^R$ and Savinase$^R$ (Novo) and Maxatase$^R$, Maxacal$^R$, Properase$^R$ and Maxapem$^R$ (Gist-Brocades); and α and β amylases such as Purafect Ox AM$^R$ (Genencor) and Termamyl$^R$, Ban$^R$, Fungamyl$^R$, Duramyl$^R$, and Natalase$^R$ (Novo); and mixtures thereof. Enzymes are preferably added herein as prills, granulates, or cogranulates at levels typically in the range from about 0.0001% to about 2% pure enzyme by weight of composition.

Bleaching Agent

Bleaching agents suitable herein include chlorine and oxygen bleaches, especially inorganic perhydrate salts such as sodium perborate mono-and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. Nos. 4,246,612, 5,227,084); Co, Cu, Mn and Fe bispyridylamine and related complexes (U.S. Pat. No. 5,114,611); and pentamine acetate cobalt (III) and related complexes (U.S. Pat. No. 4,810,410).

Low Cloud Point Non-ionic Surfactants and Suds Suppressers

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360–362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., Olin Corporation's Poly-Tergent® SLF18) and epoxy-capped poly (oxyalkylated) alcohols (e.g., Olin Corporation's Poly-Tergent® SLF18B series of nonionics, as described, for example, in U.S. Pat. No. 5,576,281).

Preferred low cloud point surfactants are the ether-capped poly(oxyalkylated) suds suppresser having the formula:

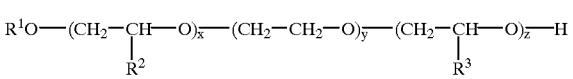

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta (methylene phosphonate), ethylenediamine tetra(methylene phosphonate)hexamethylenediamine tetra(methylene phosphonate), ethylene diphosphonate, hydroxy-ethylene-1, 1-diphosphonate, nitrilotriacetate, ethylenediaminotetracetate, ethylenediamine-N,N'-disuccinate in their salt and free acid forms.

The compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components herein include colorants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressors (see WO-93/08876 and EP-A-0705324), polymeric dye transfer inhibiting agents, optical brighteners, perfumes, fillers and clay.

Liquid detergent compositions can contain water and other volatile solvents as carriers. Low quantities of low molecular weight primary or secondary alcohols such as methanol, ethanol, propanol and isopropanol can be used in the liquid detergent of the present invention. Other suitable carrier solvents used in low quantities includes glycerol, propylene glycol, ethylene glycol, 1,2-propanediol, sorbitol and mixtures thereof.

Odor-masking Base

The odor masking base (which term includes fully-formulated odor-masking perfumes or a base composition for use therein) is preferably a mixture of ionones, musks and highly volatile perfumes. Concentrations of the odor masking base preferably range from about 0.001% to about 3%, more preferably from about 0.006% to about 2.5%, even more preferably from about 0.0075% to about 1%, by weight of the composition.

The ionones, musks and highly volatile perfumes of the odor masking base are characterized in part by their respective boiling point ranges. The ionones and musks preferably have a boiling point at 1 atmosphere of pressure of more than about 250° C., whereas the highly volatile perfume components have a boiling point at 1 atmosphere of pressure of less than about 250° C. The boiling point of many perfume materials are disclosed in, e.g., "Perfume and Flavor Chemicals (Aroma Chemicals)," S. Arctander, published by the author, 1969. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually lower pressure than the normal pressure of one atmosphere, the boiling point at normal or ambient pressure can be approximately estimated by using boiling point-pressure nomographs, such as those given in "The Chemist's Companion," A. J. Gordon and R. A. Ford, John Wiley & Sons Publishers, 1972, pp. 30–36. When applicable, the boiling point values can also be calculated by computer programs, based on molecular structural data, such as those described in "Computer-Assisted Prediction of Normal Boiling Points of Pyrans and Pyrroles," D. T. Stanton et al, J. Chem. Inf. Comput. Sci., 32 (1992), pp. 306–316, "Computer-Assisted Prediction of Normal Boiling Points of Furans, Tetrahydrofurans, and Thiophenes," D. T. Stanton et al, J. Chem. Inf. Comput. Sci., 31 (1992), pp. 301–310, and references cited therein, and "Predicting Physical Properties from Molecular Structure," R. Murugan et al, Chemtech, June 1994, pp. 17–23.

Each of the ionone perfumes, highly volatile perfumes, and musk components of the odor masking base are described in detail hereinafter.

Highly Volatile Perfume

The highly volatile perfume of the odor masking base comprises perfume materials which compete with the malodorous solvents to bind to the nasal receptor sites. These highly volatile perfumes are the first odors recognized and identified by the brain, and help inhibit or mask the olfactory recognition of the solvents. Concentrations of the highly volatile perfume range from about 15% to about 85%, preferably from about 20% to about 80%, more preferably from about 35% to about 75%, even more preferably from about 45% to about 65%, by weight of the odor masking base.

The highly volatile perfumes are more volatile than the ionone and musk components of the odor masking base, and have a boiling point of less than about 250° C., preferably less than about 230° C., more preferably less than about 220° C. at 1 atmosphere of pressure. These highly volatile perfumes are classified as either aldehydes having from about 2 to about 15 carbon atoms, esters having from about 3 to about 15 carbon atoms, alcohols having from about 4 to about 12 carbon atoms, ethers having from about 4 to about 13 carbon atoms, ketones having from about 3 to about 12 carbon atoms, or combinations thereof.

Nonlimiting examples of suitable aldehydes include n-decyl aldehyde, 10-undecen-1-al, dodecanal, 3,7-dimethyl-7-hydroxyoctan-1-al, 2,4-dimethyl-3-cyclohexene carboxaldehyde, benzaldehyde, anisic aldehyde, and mixtures thereof.

Nonlimiting examples of suitable esters include ethyl acetate, cis-3-hexenyl acetate, 2,6-dimethyl-2,6-octadien-8-yl acetate, benzyl acetate, 1,1-dimethyl-2-phenyl acetate, 2-pentyloxy allyl ester, allyl hexanoate, methyl-2-aminobenzoate, and mixtures thereof.

Nonlimiting examples of suitable alcohols include n-octyl alcohol, beta-gamma-hexenol, 2-trans-6-cis-nonadien-1-ol, 3,7-dimethyl-trans-2,6-octadien-1-ol, 3,7-dimethyl-6-octen-1-ol, 3,7-dimethyl-1,6-octadien-3-ol, 2,6-dimethyl-7-octen-2-ol, 2-phenylethyl alcohol, 2-cis-3,7-dimethyl-2,6-octadien-1-ol, 1-methyl-4-iso-propyl-1-cyclohexen-8-ol, and mixtures thereof.

Nonlimiting examples of suitable ethers include amyl cresol oxide, 4-ethoxy-1-methylbenzol, 4-methoxy-1-methyl benzene, methyl phenylethyl ether, and mixtures thereof.

Nonlimiting examples of suitable ketones include dimethyl acetophenone, ethyl-n-amyl ketone, 2-heptanone, 2-octanone, 3-methyl-2-(cis-2-penten-1-yl)-2-cyclopenten-1-one, 1-1-methyl-4-iso-propenyl-6-cyclohexen-2-one, para-tertiary-amyl cyclohexanone, and mixtures thereof.

Preferred highly volatile perfumes include 2-pentyloxy allyl ester sold under the tradename Allyl Amyl Glycolate (available from International Flavors and Fragrances, Inc. located in New York, N.Y., U.S.A.); benzaldehyde sold under the tradename Amandol (available from Rhone-Poulenc, Inc located in Princeton, N.J., U.S.A.); cis-3-hexenyl acetate sold under the tradename Verdural extra (available from International Flavors and Fragrances, Inc. located in New York, N.Y., U.S.A.); 2,6-dimethyl-7-octen-2-ol sold under the tradename Dihydromyrcenol (available from International Flavors and Fragrances, Inc. located in New York, N.Y., U.S.A.); para-tertiary-amyl cyclohexanone sold under the tradename Orivone (available from International Flavors and Fragrances, Inc. located in New York, N.Y., U.S.A.); n-decyl aldehyde sold under the tradename Decyl Aldehyde (available from Aceto, Corp. located in Lake Success, N.Y., U.S.A.); and mixtures thereof.

Nonlimiting examples of suitable highly volatile perfumes and their respective boiling point values at 1 atmosphere of pressure are given in U.S. Pat. No. 5,919,440.

Ionone

The odor masking base preferably comprises an ionone perfume component (i.e. an ionone or mixture of ionones) at concentrations ranging from about 15% to about 80%, preferably from about 16% to about 60%, more preferably from about 16% to about 40%, by weight of the odor masking base. Ionones are a well known class of perfume chemicals derived from natural oils or manufactured synthetically, which are typically colorless or pale yellow liquids exhibiting woody violet-like odors.

The ionone perfume for use in the odor masking base has a boiling point at 1 atmosphere of pressure of more than about 250° C., preferably more than about 255° C., even more preferably more than about 260° C., wherein the ionone perfume is preferably selected from methyl ionones, alpha ionones, beta ionones, gamma ionones, or combinations thereof.

Nonlimiting examples of suitable ionones include 1-(2,6,6-Trimethyl-2-cyclohexene-1-yl)-1,6-heptadien-3-one, 2-Allyl-para-menthene-(4(8))-ono-3, Pseudo-allyl-alpha-ionone, alpha-Citrylidene cyclopentanone, 5-(2,6,6-Trimethyl-2-cyclohexen-1-yl)-4-methyl-4-penten-3-one, 6-(2,6,6-Trimethyl-2-cyclohexen-1-yl)-1-methyl-5-hexen-4-one, 2,6,6-Trimethyl cyclohexyl-1-butenone-3, Dihydro-alpha-ionone, 4-(2,6,6-Trimethylcyclohexen-1-yl)-butan-2-one, 4-(2-Methylene-6,6-dimethylcyclohexyl)-butan-2-one, 1-(2,5,6,6-Tetramethyl-2-cyclohexenyl)-butan-3-one, Dihydro-beta-irone, Dihydro-gamma-irone, 5-(2,6,6-Trimethyl-2-cyclohexenyl)-pentan-3-one, Dihydro-iso-methyl-beta-ionone, 6-(2,6,6-Trimethyl-2-cyclohexen-1-yl)-5-hexen-4-one, alpha-Ethyl-2,2,6-trimethyl cyclohexane butyric aldehyde, 4-Methyl-6-(1,1,3-trimethyl-2'-cyclohexen-2'-yl)-3,5-hexadien-2-one, 6,10-Dimethyl undecan-2-one, 6-(2,6,6-Trimethyl-1-cyclohexen-1-yl)-1-methyl-2,5-hexadien-4-one, 6-(2,6,6-Trimethyl-2-cyclohexen-1-yl)-1-methyl-2,5-hexadien-4-one, 4-(2,2,6-Trimethyl-2-cyclohexen-1-yl)-3-buten-2-one, 4-(2,6,6-Trimethyl-1-cyclohexen-1-yl)-3-buten-2-one, 4-(2-Methylene-6,6-dimethylcyclohexyl)-3-buten-2-one, Epoxy-2,3-beta-ionone, Ethyl-2,3-epoxy-3-methyl-5-(2,6,6-trimethyl-2-cyclohexenyl)-4-pentenoate, alpha-ionone methylanthranilate, Methyl-2,3-epoxy-3-methyl-5-(2,6,6-trimethyl-2-cyclohexenyl)-4-pentenoate, 4-(2,5,6,6-Tetramethyl-2-cyclohexen-1-yl)-3-buten-2-one, 6-Methyl-beta-ionone, 6-Methyl-gamma-ionone, 4-(2,6,6-Trimethyl-2-cyclohexenyl)-2,3-dimethyl-2-buten-1-al, 4-(2,6,6-Trimethyl-2-cyclohexen-1-yl)-3-methyl-3-buten-2-one, 5-(2,6,6-Trimethyl-2-cyclohexen-1-yl)-4-penten-3-one, 5-(2,6,6-Trimethyl-1-cyclohexen-1-yl)-4-penten-3-one, 4-(2,6,6-Trimethyl-3-cyclohexen-1-yl)-3-methyl-3-buten-2-one, 5-(2-Methylene-6,6-dimethylcyclohexyl)-4-penten-3-one, 4-(2-Methylene-6,6-dimethylcyclohexyl)-3-methyl-3-buten-2-one, 4-(2,3,6,6-Tetramethyl-2-cyclohexen-1-yl)-3-buten-2-one, 4-(2,4,6,6-Tetramethyl-2-cyclohexen-1-yl)-3-buten-2-one, 4-(2,4,6,6-Tetramethyl-1-cyclohexen-1-yl)-3-buten-2-one, 5-Methyl-1-(3-methyl-3-cyclohexenyl)-1,3-hexanedione, 2-Methyl-4-(2,6,6-trimethyl-2-cyclohexenyl)-3-buten-1-al, 3-Methyl-4-(2,4,6-trimethyl-3-cyclohexenyl)-3-buten-2-one, 4-(2-Methyl-5-iso-propenyl-1-cyclopenten-1-yl)-2-butanone, 4-(2,6,6-Trimethyl-7-cycloheptenyl)-3-buten-2-one, 4-(2,6,6-Trimethyl-4-cyclohexenyl)-3-buten-2-one, 2,6-Dimethylundeca-2,6,8-trien-10-one, 2,6,12-Trimethyltrideca-2,6,8-trien-10-one, 2,6-Dimethyldodeca-2,6,8-trien-10-one, 2,6,9-Trirethylundeca-2,6,8-trien-10-one, 4-(2,6,6-Trimethyl-2-cyclohexen-1-yl)-3-methyl-3-buten-2-one, 4-(2,4,6-Trimethyl-3-cyclohexen-1-yl)-3-buten-2-one, 5-(2-Methylene-6,6-dimethylcyclohexyl)-4-penten-3-one, and mixtures thereof.

Preferred ionones include 4-(2,6,6-Trimethyl-3-cyclohexen-1-yl)-3-methyl-3-buten-2-one sold under the tradename Isoraldeine (available from Givaudan Roure, Corp. located in Teaneck, N.J., U.S.A.); 5-(2-Methylene-6, 6-dimethylcyclohexyl)-4-penten-3-one sold under the tradename gamma-Methyl Ionone (available from Givaudan Roure, Corp. located in Teaneck, N.J., U.S.A.); 4-(2,2,6-Trimethyl-2-cyclohexen-1-yl)-3-buten-2-one sold under the tradename alpha-Ionone (available from International Flavors and Fragrances, Inc. located in New York, N.Y., U.S.A); 4-(2,6,6-Trimethyl-1-cyclohexen-1-yl)-3-buten-2-one sold under the tradename beta-Ionone (available from International Flavors and Fragrances, Inc. located in New York, N.Y., U.S.A); 4-(2,6,6-Trimethyl-2-cyclohexen-1-yl)-3-methyl-3-buten-2-one sold under the tradename Methyl Ionone (available from Bush Boake Allen, Inc. located in Montvale, N.J., U.S.A.); and mixtures thereof.

Ionones may be incorporated into the odor masking base as one or more individual perfume chemicals or as a specialty perfume containing a combination of perfume chemicals including ionone perfume chemicals. Nonlimiting examples of ionone specialty perfumes include Alvanone Extra available from International Flavors and Fragrances, Inc. located in New York, N.Y., U.S.A., Irisia Base available from Firmenich, Inc located in Princeton, N.J., U.S.A., Irival available from International Flavors and Fragrances, Inc. located in New York, N.Y., U.S.A., Iritone available from International Flavors and Fragrances, Inc. located in New York, N.Y., U.S.A., and mixtures thereof.

Other suitable ionones containing materials for use herein are natural materials such as mimosa, violet, iris, orris and mixtures thereof.

The musk and highly volatile perfumes for use in the odor masking base can also be incorporated into the base as one or more individual perfume chemicals, or as a specialty perfume containing a combination of perfume chemicals. A nonlimiting example of a preferred highly volatile specialty perfume include Cassis Base 345-B available from Firmenich, Inc. located in Princeton, N.J., U.S.A. Nonlimiting examples of suitable ionone perfumes and their respective boiling point values at 1 atmosphere of pressure are given in U.S. Pat. No. 5,919,440.

Musk

The odor masking base preferably comprises a musk component at concentrations of from about 5% to about 70%, preferably from about 15% to about 50%, more preferably from about 20% to about 35%, by weight of the odor masking base. Musk is a well known class of perfumes chemicals that is typically in the form of a colorless or light yellow material having a distinctive, musk-like odor.

The musk component for use in the odor masking base must have a boiling point at 1 atmosphere of pressure of more than about 250° C., preferably more than about 255° C., even more preferably more than about 260° C., wherein the musk component is preferably a polycyclic musk, macrocyclic musk, nitrocyclic musk, or combination thereof, each preferred musk component having more than about 12 carbon atoms, preferably more than about 13 carbon atoms, more preferably more than about 15 carbon atoms.

Suitable polycyclic musks include 5-Acetyl-1,1,2,3,3,6-hexamethylindan, 4-Acetyl-1,1-dimethyl-6-tertiary-butylindan, 7-Acetyl-1,1,3,4,4,6-hexamethyl-1,2,3,4-tetrahydronaphthalene, 1,1,4,4-Tetramethyl-6-ethyl-7-acetyl-1,2,3,4-tetrahydronaphthalene, 1,3,4,6,7,8-Hexahydro-4,6,6,7,8,8-hexamethyl-cyclopenta-gamma-2-benzopyran, and mixtures thereof.

Suitable macrocyclic musks include cyclopentadecanolide, cyclopentadecanolone, cyclopentadecanone, 3-Methyl-1-cyclopentadecanone, cycloheptadecen-9-one-1, cycloheptadecanone, cyclohexadecen-7-olide, cyclohexadecen-9-olide, cyclohexadecanolide, ethylene tridecane dioate, 10-oxahexadecanolide, 11-oxahexadecanolide, 12-oxahexadecanolide, and mixtures thereof.

Suitable nitrocyclic musks include 1,1,3,3,5-Pentamethyl-4,6-dinitroindan, 2,6-Dinitro-3-methoxy-1-methyl-4-tertiary-butylbenzene, 2,6-Dimethyl-3,5-dinitro-4-tertiary-butyl-acetophenone, 2,6-Dinitro-3,4,5-trimethyl-tertiary-butyl-benzene, 2,4,6-Triinitro-1,3-dimethyl-5-tertiary-butylbenzene, and mixtures thereof.

Preferred musks include 1,3,4,6,7,8-Hexahydro-4,6,6,7,8,8-hexamethyl-cyclopenta-gamma-2-benzopyran sold under the tradename Galaxolide (available from International Flavors and Fragrances, Inc. located in New York, N.Y., U.S.A.); cyclopentadecanolide sold under the tradename Exaltolide (available from Firmenich, Inc. located in Princeton, N.J., U.S.A.); ethylene tridecane dioate sold under the tradename Ethylene Brassylate (available from Fragrance Resource, Inc. located in Keyport, N.J., U.S.A.); 7-Acetyl-1,1,3,4,4,6-hexamethyl-1,2,3,4-tetrahydronaphthalene sold under the tradename Tonalid (available from Givaudan Roure, Corp. located in Teaneck, N.J., U.S.A.); and mixtures thereof. Nonlimiting examples of suitable musks and their respective boiling point values at 1 atmosphere of pressure are given in U.S. Pat. No. 5,919,440.

EXAMPLES

Abbreviations Used in Examples

In the examples, the abbreviated component identifications have the following meanings:

| | |
|---|---|
| Carbonate | Anhydrous sodium carbonate |
| Silicate | Amorphous Sodium Silicate ($SiO_2$:$Na_2O$ ratio = 2.0) |
| Laponite clay | Synthetic layered silicate available from Southern Clay Products, Inc. |
| SLF18 | low foaming surfactant available of formula $C_9(PO)_3(EO)_{12}(PO)_{15}$ from Olin Corporation |
| ACNI | alkyl capped non-ionic surfactant of formula $C_{9/11}$ $H_{19/23}$ $EO_8$-cyclohexyl acetal |
| $C_{16}AO$ | hexadecyl dimethyl amine oxide |
| $C_{12}AO$ | dodecyl dimethyl amine oxide |
| Proxel GXL | preservative(1,2-benzisothiazolin-3-one) available from Zeneca, Inc |
| Polygel premix | 5% active Polygel DKP in water available from 3 V Inc. |
| MEA | Monoethanolamine |
| MAE | 2-(methylamino)ethanol |
| SF1488 | Polydimethylsiloxane copolymer |
| Butyl Carbitol | Diethylene glycol monobutyl ether |
| Dowanol PNB | Propylene glycol butyl ether |
| Cyclodextrin | Beta cyclodextrin available from Cerestar |

In the following examples all levels are quoted as parts by weight.

Examples 1 to 16

Examples 1 to 16 illustrate pre-treatment compositions used to facilitate the removal of cooked-on, baked-on and burnt-on food soils prior to the dishwashing process. The compositions of the examples are applied to a dishware load. The load comprises different soils and different substrates: lasagne baked for 2 hours at 140° C. on Pyrex, lasagne cooked for 2 hours at 150° C. on stainless steel, potato and cheese cooked for 2 hours at 150° C. on stainless steel, egg yolk cooked for 2 hours at 150° C. on stainless steel and sausage cooked for 1 hour at 120° C. followed by 1 hour at 180° C. The dishware load is allowed to soak for 10 minutes in the compositions of the examples, then the dishware is rinsed under cold tap water. The dishware load is thereafter washed either manually or in an automatic dishwashing machine, for example in a Bosch 6032 dishwashing machine, at 55° C. without prewash, using a typical dishwashing detergent compositions containing, for example, alkalinity source, builders, enzymes, bleach, bleach catalyst, non-ionic surfactant, suds-suppresser, silver corrosion inhibitor, soil suspending polymers, etc. The dishware load treated with compositions of the examples and thereafter washed in the dishwashing machines present excellent removal of cooked-on, baked-on and burnt-on food soils.

| Pre-treatment | Example | | | |
|---|---|---|---|---|
| composition | 1 | 2 | 3 | 4 |
| Butyl Carbitol | 5.00 | 5.00 | 5.00 | 5.00 |
| Dowanol PNB | 5.00 | 5.00 | 5.00 | 5.00 |
| MEA | 5.00 | 5.00 | 5.00 | 5.00 |
| Carbonate | 2.00 | 2.00 | 2.00 | 2.00 |
| $C_{16}AO$ | 3.00 | | 1.5 | 1.5 |
| SLF18 | | 3.00 | | 1.5 |
| ACNI | | | 1.5 | |
| Polygel DKP | 1.00 | 1.00 | 1.00 | 1.00 |
| Water | 79.00 | 79.00 | 79.00 | 79.00 |

| Pre-treatment | Example | | | |
|---|---|---|---|---|
| composition | 5 | 6 | 7 | 8 |
| Laponite clay | 1.0 | 0.5 | 0.8 | 0.3 |
| Sodium silicate | 0.3 | 0.3 | 0.3 | 0.3 |
| Sodium cumene sulfonate | 1.0 | 1.0 | 1.0 | 1.0 |
| Butyl Carbitol | 5.00 | 5.00 | 5.00 | 5.00 |
| Dowanol PNB | 5.00 | 5.00 | 5.00 | 5.00 |
| MEA | 5.00 | 5.00 | 5.00 | 5.00 |
| Carbonate | 2.00 | 2.00 | 2.00 | 2.00 |
| $C_{16}AO$ | 1.00 | | 1.5 | 1.5 |
| SLF18 | | 3.00 | | 1.5 |
| ACNI | | | 1.5 | |
| Polygel DKP | | 0.5 | 0.2 | 0.7 |
| Perfume | 0.2 | 0.2 | 0.2 | 0.2 |
| Water | | to 100 | | |

| Pre-treatment | Example | | | |
|---|---|---|---|---|
| composition | 9 | 10 | 11 | 12 |
| Laponite clay | 1.0 | 0.5 | 0.8 | 0.6 |
| Xanthan gum | | 0.3 | 0.2 | 0.4 |
| Sodium silicate | 0.3 | 0.3 | 0.3 | 0.3 |
| Sodium hydroxide | 0.5 | 1.0 | 1.0 | 1.0 |
| Butyl Carbitol | 5.00 | 5.00 | 5.00 | 5.00 |
| Dowanol PNB | 5.00 | 5.00 | 5.00 | 5.00 |
| MEA | 5.00 | 5.00 | 5.00 | 5.00 |
| Carbonate | 2.00 | 2.00 | 2.00 | 2.00 |
| $MgCl_2$ | 1.00 | | | |
| $C_{16}AO$ | 1.00 | 3.00 | 1.5 | 1.5 |
| SLF18 | | | | 1.5 |
| ACNI | | | 1.5 | |
| Masking perfume | 0.1 | 0.1 | 0.1 | 0.1 |
| Perfume | 0.1 | 0.1 | 0.1 | 0.1 |
| Water | | to 100 | | |

| Pre-treatment | Example | | | |
|---|---|---|---|---|
| composition | 13 | 14 | 15 | 16 |
| Laponite clay | 1.0 | 1.25 | 0.8 | 0.3 |
| Xanthan gum | | 0.15 | 0.2 | 0.4 |
| Sodium silicate | 0.3 | 0.75 | 0.3 | 0.3 |
| Sodium hydroxide | 0.5 | 0.4 | 1.0 | 1.0 |
| Butyl Carbitol | 5.00 | 5.00 | 5.00 | 5.00 |
| Dowanol PNB | 5.00 | 5.00 | 5.00 | 5.00 |
| MEA | 5.00 | 5.00 | 5.00 | 5.00 |
| Carbonate | 2.00 | 2.00 | 2.00 | 2.00 |
| $MgCl_2$ | 1.00 | | | |
| $C_{12}AO$ | 1.00 | 1.0 | 1.5 | 1.5 |
| SLF18 | | | | 1.5 |
| ACNI | | | 1.5 | |
| Cyclodextrin | 1.00 | 1.00 | | |
| Masking perfume | | 0.2 | 0.1 | 0.2 |
| Perfume | 0.15 | 0.2 | 0.1 | |
| Water | | to 100 | | |

All the examples have a liquid surface tension at 25° C. of below 24.5 mN/m, a pH of at least 12 and a 45 min soil swelling index on polymerized grease soil/stainless steel substrate of at least 200%.

The masking perfume composition is given in the following table:

| Ingredient | % |
|---|---|
| Allyl amyl glycolate | 0.5 |
| Alvanone extra | 2.0 |
| Benzaldehyde | 0.5 |
| Cassis base 345 | 3.0 |
| Cis-3-hexenyl acetate | 1.0 |
| Decyl aldehyde | 01.0 |
| Dihydro Myrcenol | 63.0 |
| Exaltolide | 4.50 |
| Habanolide | 10.50 |
| Ionone gamma methyl | 3.0 |
| Irisia base | 10.00 |
| Orivone | 1.0 |

What is claimed:

1. A hard surface cleaning composition for removing cooked-, baked-, or burnt-on soils from cookware and tableware, the composition comprising:

a) a solvent system comprising:

i) an organoamine solvent;

ii) a water-miscible organic solvent; and iii) a limited water-miscible organic solvent wherein the water-miscible organic solvent and the limited water-miscible organic solvent are selected from the group consisting of: alcohols, glycols, esters, glycol ethers, terpenes and mixtures thereof; and b) optionally, a surfactant;

wherein the composition has a liquid surface tension of less than 24.5 mN/m.

2. The composition according to claim 1 wherein the composition has a pH as measured in a 10% solution of distilled water of at least 10.5.

3. The composition according to claim 1 wherein the composition has a reserve alkalinity of less than about 5.

4. The composition according to claim 1 wherein the surfactant is present in the composition at a level of from about 0.05% to about 10% by weight of the composition.

5. The composition according to claim 1 wherein the surfactant is selected from the group consisting of: anionic, amphoteric, zwitterionic, nonionic and semi-polar surfactants and mixtures thereof.

6. The composition according to claim 5 wherein the surfactant comprises an amine oxide.

7. The composition according to claim 1 wherein the organoamine solvent is selected from the group consisting of alkanolamines, alkylamines, alkyleneamines and mixtures thereof.

8. The composition according to claim 7 wherein the organoamine solvent comprises an alkanolamine.

9. The composition according to claim 1 wherein the water-miscible organic solvent is selected from the group consisting of: alcohols, glycols, glycol ethers and mixtures thereof.

10. The composition according to claim 9 wherein the water-miscible organic solvent comprises a glycol ether.

11. The composition according to claim 10 wherein the water-miscible organic solvent comprises diethylene glycol monobutyl ether.

12. The composition according to claim 1 wherein the limited water-miscible organic solvent is selected from the group consisting of: alcohols, glycols, glycol ethers, esters, terpenes and mixtures thereof.

13. The composition according to claim 12 wherein the limited water-miscible organic solvent comprises a glycol ether.

14. The composition according to claim 13 wherein the limited water-miscible organic solvent comprises propylene glycol butyl ether.

15. The composition according to claim 1 wherein the composition is capable or displaying an advancing contact angle on a soiled glass substrate at 25° of less than about 200°.

16. The composition according to claim 1 wherein the composition exhibits a soil swelling index of at least about 100%.

17. The composition according to claim 1 wherein the solvent system is present in the composition at a level of from about 10% to about 40% by weight of the composition.

18. The composition according to claim 17 wherein the solvent system comprises from about 1% to about 15% by weight of the composition of the organoamine solvent.

19. The composition according to claim 17 wherein the solvent system comprises from about 7% to about 30% by weight of the composition of a mixture of the water-miscible and limited water-miscible organic solvent.

20. The composition according to claim 19 wherein the solvent system comprises at least about 3.5% by weight of the composition of the water-miscible organic solvent.

21. The composition according to claim 19 wherein the solvent system comprises at least about 3.5% by weight of the composition of the limited water-miscible organic solvent.

22. The composition according to claim 1 wherein the weight ratio of water-miscible organic solvent to limited water-miscible organic solvent is from about 2:1 to about 1:6.

23. The composition according to claim 1 wherein the surfactant lowers the liquid surface of the solvent system to at least 1 mN/m less than the liquid surface tension of the surfactant.

24. The composition according to claim 1 wherein the composition has a soil removal index of at least 25%.

25. The composition according to claim 1 wherein the composition is in the form of a shear thinning fluid having a shear index (n) of from about 0.3 to about 0.7 and a consistency index of from about 0.20 to about 0.15 $Pa.s^n$.

26. The composition according to claim 25 wherein the composition has a flow velocity of less than about 1 cm/s when sprayed on a vertical stainless steel surface.

27. The composition according to claim 1 wherein the composition further comprises a thickening agent selected from the group consisting of synthetic smectite clays, natural gums and mixtures thereof.

28. The composition according to claim 1 wherein the organoamine and the mixture of the water-miscible and limited water-miscible organic solvents are present in the solvent system at a weight ratio of from about 3:1 to about 1:3.

29. The composition according to claim 1 wherein the solvent system has a volatile organic solvent content above 1 mm Hg of less than about 50%.

30. The composition according to claim 1 wherein the solvent system is essentially free of solvent components that have a boiling point below about 150° C. and/or a flash point below about 50° C. and/or a vapor pressure of above about 1 mm Hg.

31. The composition according to claim 1 wherein the composition is in the form of a dishwashing pretreatment composition.

32. The composition according to claim 1 wherein the composition is in the form of an automatic dishwashing detergent composition.

33. The composition according to claim 1 wherein the composition further comprises a salt having a divalent cation.

34. The composition according to claim 1 wherein the composition further comprises a perfume component.

35. The composition according to claim 34 wherein the perfume component comprises an ionone.

36. The composition according to claim 33 wherein the ionone is derived from a natural containing ionone material selected from the group consisting of: mimosa, violet, iris, orris and mixtures thereof.

37. The composition according to claim 34 wherein the perfume component comprises a music having a boiling point of greater than about 250° C.

38. The composition according to claim 1 wherein the composition further comprises a cyclodextrin.

39. A hard surface cleaning composition for removing cooked-, baked-, or burnt-on soils from cookware and tableware, the composition comprising:

a) a solvent system comprising less than or equal to about 20% by weight of the composition, said solvent system comprising:
   i) an organoamine;
   ii) a water-miscible organic solvent; and
   iii) a limited water-miscible organic solvent
   wherein the water-miscible organic solvent and the limited water-miscible organic solvent are selected from the group consisting of: alcohols, glycols, esters, glycol ethers, terpenes and mixtures thereof; and b) a surfactant at a level of from about 0.05% to about 10% by weight of the composition;

wherein the composition has a liquid surface tension of less than 24.5 mN/m.

40. A hard surface cleaning composition for removing cooked-, baked-, or burnt-on soils from cookware and tableware, the composition comprising:

a) a solvent system comprising:
   i) a water-miscible organic solvent comprising a glycol ether; and
   ii) a limited water-miscible organic solvent comprising a dipropylene ether;

b) monoethanolamine; and c) a surfactant at a level of from about 0.09% to about 5% by weight of the composition;

wherein the composition has a liquid surface tension of less than 24.5 mN/m.

* * * * *